US011624989B2

(12) United States Patent
Umeda et al.

(10) Patent No.: US 11,624,989 B2
(45) Date of Patent: Apr. 11, 2023

(54) IMAGE FORMING APPARATUS TO SUPPLY TONER

(71) Applicant: CANON KABUSHIKI KAISHA, Tokyo (JP)

(72) Inventors: Kensuke Umeda, Kanagawa (JP); Shinsuke Kobayashi, Kanagawa (JP); Ai Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/543,225

(22) Filed: Dec. 6, 2021

(65) Prior Publication Data

US 2022/0187735 A1 Jun. 16, 2022

(30) Foreign Application Priority Data

Dec. 11, 2020 (JP) ..... JP2020-206316

(51) Int. Cl.

| | |
|---|---|
| ***G03G 15/08*** | (2006.01) |
| ***G03G 15/20*** | (2006.01) |
| ***G03G 21/00*** | (2006.01) |
| ***G03G 21/16*** | (2006.01) |
| *G03G 15/00* | (2006.01) |

(52) U.S. Cl.
CPC ..... *G03G 15/0877* (2013.01); *G03G 15/0874* (2013.01); *G03G 15/2039* (2013.01);
(Continued)

(58) Field of Classification Search
CPC ..... G03G 15/0874; G03G 15/0877; G03G 15/0896; G03G 15/0875; G03G 15/2039;
(Continued)

(56) References Cited

U.S. PATENT DOCUMENTS 5,091,750 A * 2/1992 Yoshida ..... G03G 15/0865 141/366
5,150,162 A * 9/1992 Saito ..... G03G 15/0877 399/223

(Continued)

FOREIGN PATENT DOCUMENTS

JP H0830084 A 2/1996
JP 2004212511 A 7/2004

(Continued)

*Primary Examiner* — Robert B Beatty
(74) *Attorney, Agent, or Firm* — Canon U.S.A., Inc. I.P. Division

(57) ABSTRACT

An image forming apparatus includes a developer bearing member, a frame having a storage member, and a first temperature detection unit. The storage member is for storing a developer for the developer bearing member to record an image on a recording material. The storage member includes an attachment part in which a supply container enclosing a developer is removably attachable to the attachment part. With reference to a recording material conveyance path having a center in a width direction of the recording material that is orthogonal to a recording material conveyance direction and in a case where an area on one side of the conveyance path center is a first area and the area on the other side of the conveyance path center is a second area, the attachment part is arranged in the first area and the first temperature detection unit is arranged in the second area.

24 Claims, 8 Drawing Sheets

(52) U.S. Cl.
CPC ..... *G03G 21/1633* (2013.01); *G03G 15/0868* (2013.01); *G03G 15/0891* (2013.01); *G03G 15/2017* (2013.01); *G03G 15/5045* (2013.01); *G03G 2215/0682* (2013.01)

(58) Field of Classification Search
CPC ..... G03G 15/2042; G03G 21/1604; G03G 2215/066; G03G 2215/0682; G03G 2215/0673; G03G 2215/0678; G03G 2215/068; G03G 21/1633
USPC ..... 399/69, 258, 262
See application file for complete search history.

(56) References Cited

U.S. PATENT DOCUMENTS 5,434,655 A * 7/1995 Okamura ..... G03G 15/0865 399/119
5,737,675 A * 4/1998 Okada ..... G03G 15/0865 399/258
6,070,035 A * 5/2000 Fujita ..... G03G 15/0879 399/258
6,212,338 B1 * 4/2001 Hagihara ..... G03G 15/0863 399/46
6,269,234 B1 * 7/2001 Kurz ..... G03G 15/0896 399/258
11,209,754 B2 * 12/2021 Lee ..... G03G 15/0877
2007/0134018 A1 * 6/2007 Nanba ..... G03G 15/2042 399/69
2021/0041803 A1 * 2/2021 Kobayashi ..... G03G 15/0889
2021/0103246 A1 * 4/2021 Morihara ..... G03G 15/556

FOREIGN PATENT DOCUMENTS

JP 2008165002 A 7/2008
JP 2013117580 A 6/2013
JP 2017058268 A 3/2017
JP 2020086450 A 6/2020

* cited by examiner

FIG.6A

| | 70 g | 50 g | 30 g |
|---|---|---|---|
| EXAMPLE | ○ | ○ | ○ |
| COMPARATIVE EXAMPLE | ○ | ○ | × |

FIG.6B

| TONER AMOUNT (g) | TONER BEARING AMOUNT ($g/cm^2$) |
|---|---|
| 100 | 4.2 |
| 70 | 4.5 |
| 50 | 5.0 |
| 30 | 6.0 |

IMAGE FORMING APPARATUS TO SUPPLY TONER

BACKGROUND

Field

The preset disclosure relates to an image forming apparatus such as a laser printer, a copier, and a facsimile.

Description of the Related Art

In general, an electrophotographic image forming apparatus forms an image by transferring a developer image (toner image) formed on the surface of a photoconductive drum onto a recording material as a transfer medium. Various developer supply systems have been proposed. Examples of the supply systems includes a process cartridge system. In the process cartridge system, a photoconductive drum and a developer container are integrated, and when the developer has run out, the process cartridge is replaced with a new one. This system has the advantage of allowing the user to perform maintenance easily on his/her own.

Meanwhile, there is also known a toner supply system in which, when toner has run out, new toner is supplied to a development device. Japanese Patent Application Laid-Open No. 8-30084 discusses a system that provides a toner supply container attachable to and detachable from an image forming apparatus. In the system discussed in Japanese Patent Application Laid-Open No. 8-30084, when the toner supply container is attached to the image forming apparatus, toner is conveyed from the toner supply container to a developer container of the image forming apparatus via a toner conveyance path provided with a conveyance screw. In addition, Japanese Patent Application Laid-Open No. 2020-86450 discusses a system in which a toner supply container is attached to an attachment port so that the toner is supplied from the toner supply container to a developer container.

In the toner supply system, if new toner is supplied to the developer container in which the old toner still remains, the developer container contains the toner in different states. This may cause uneven toner amounts in the developed image. As a result, the toner amount may increase, which can eventually cause a fixing failure.

SUMMARY

According to an aspect of the present disclosure, an image forming apparatus includes an image bearing member, a developer bearing member configured to develop an electrostatic latent image formed on the image bearing member as an image using a developer, a frame configured to support the developer bearing member and including a storage member for storing the developer, where the stored developer is to be supplied to the developer bearing member, a transfer unit configured to transfer the developed image onto a recording material, a fixing unit configured to fix the image to the recording material, a first temperature detection unit configured to detect a temperature of the fixing unit, and a control unit configured to, based on a result of detection by the first temperature detection unit, control supply of electric power to the fixing unit, wherein the storage member includes an attachment part in which a supply container with a developer enclosed in the supply container is attachable to and detachable from the attachment part, and wherein, with reference to a conveyance path having a center in a width direction of the recording material that is orthogonal to a conveyance direction of the recording material and in a case where an area on one side of the conveyance path center is designated as a first area and the area on the other side of the conveyance path center is designated as a second area, the attachment part is arranged in the first area and the first temperature detection unit is arranged in the second area.

Further features of the present disclosure will become apparent from the following description of exemplary embodiments with reference to the attached drawings.

BRIEF DESCRIPTION OF THE DRAWINGS

FIGS. 6A and 6B are diagrams illustrating evaluation results.

DESCRIPTION OF THE EMBODIMENTS

Hereinafter, exemplary embodiments of the present disclosure will be described with reference to the drawings. However, the following exemplary embodiments do not limit the present disclosure defined in the claims, and all of combinations of features described in relation to the exemplary embodiments are not necessarily essential to the solutions of the present disclosure.

Overall Configuration of Image Forming Apparatus 1

Figure 1A:
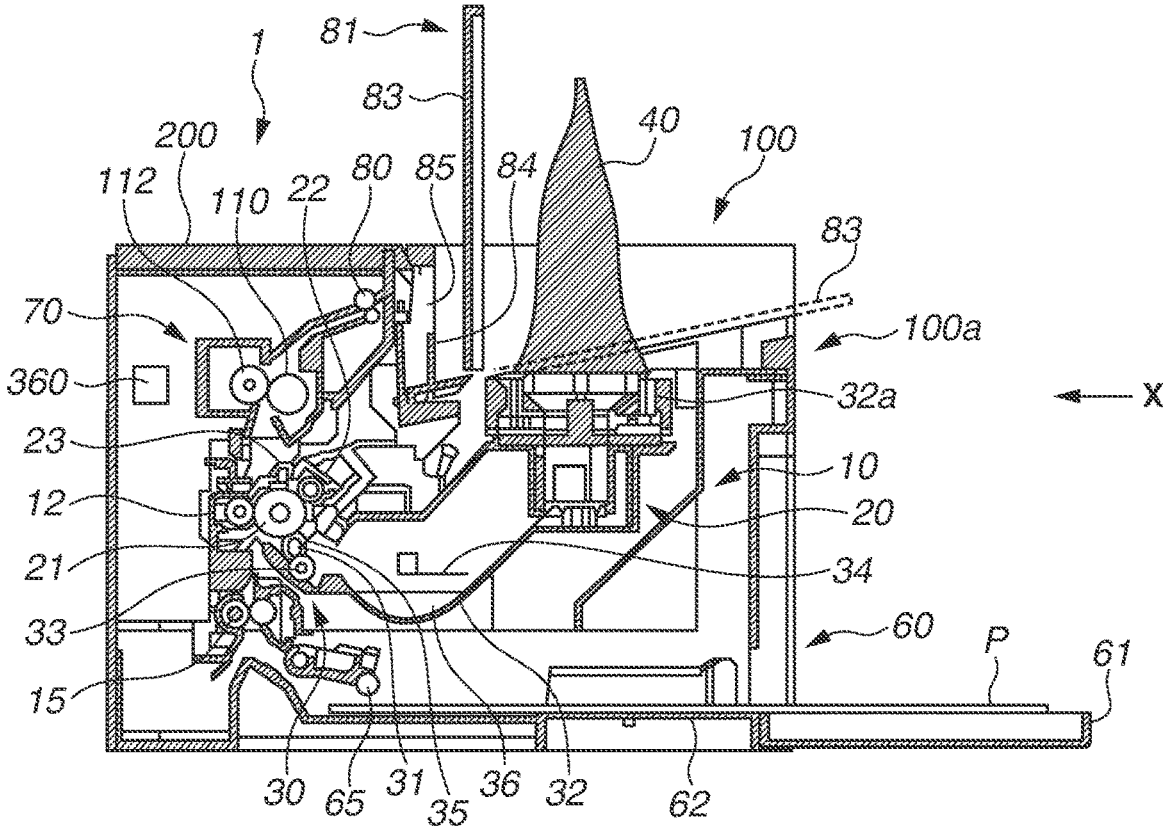
FIG. 1A is a schematic configuration diagram of an image forming apparatus.

Hereinafter, a first exemplary embodiment will be described. FIG. 1A is a schematic configuration diagram of an image forming apparatus 1. The image forming apparatus 1 is a monochrome printer that forms a monochrome image on a recording material P based on image information input from an external device (not illustrated). Examples of the recording material P on which an image is to be formed include paper such as plain paper and cardboard, plastic films such as overhead projector sheets, specially shaped sheets such as envelopes and index paper, cloth, and the like. FIG. 1A illustrates a configuration of the image forming apparatus 1 when viewed along a direction of a rotational axis of a photoconductive drum 21 described below. The upward and downward direction is parallel to the perpendicular direction, and the rightward and leftward direction is parallel to the horizontal direction. Rotational axes of a development roller 31, a discharge roller pair 80, a registration roller pair 15, and a cover 83 described below are parallel to the rotational axis of the photoconductive drum 21.

Figure 2:
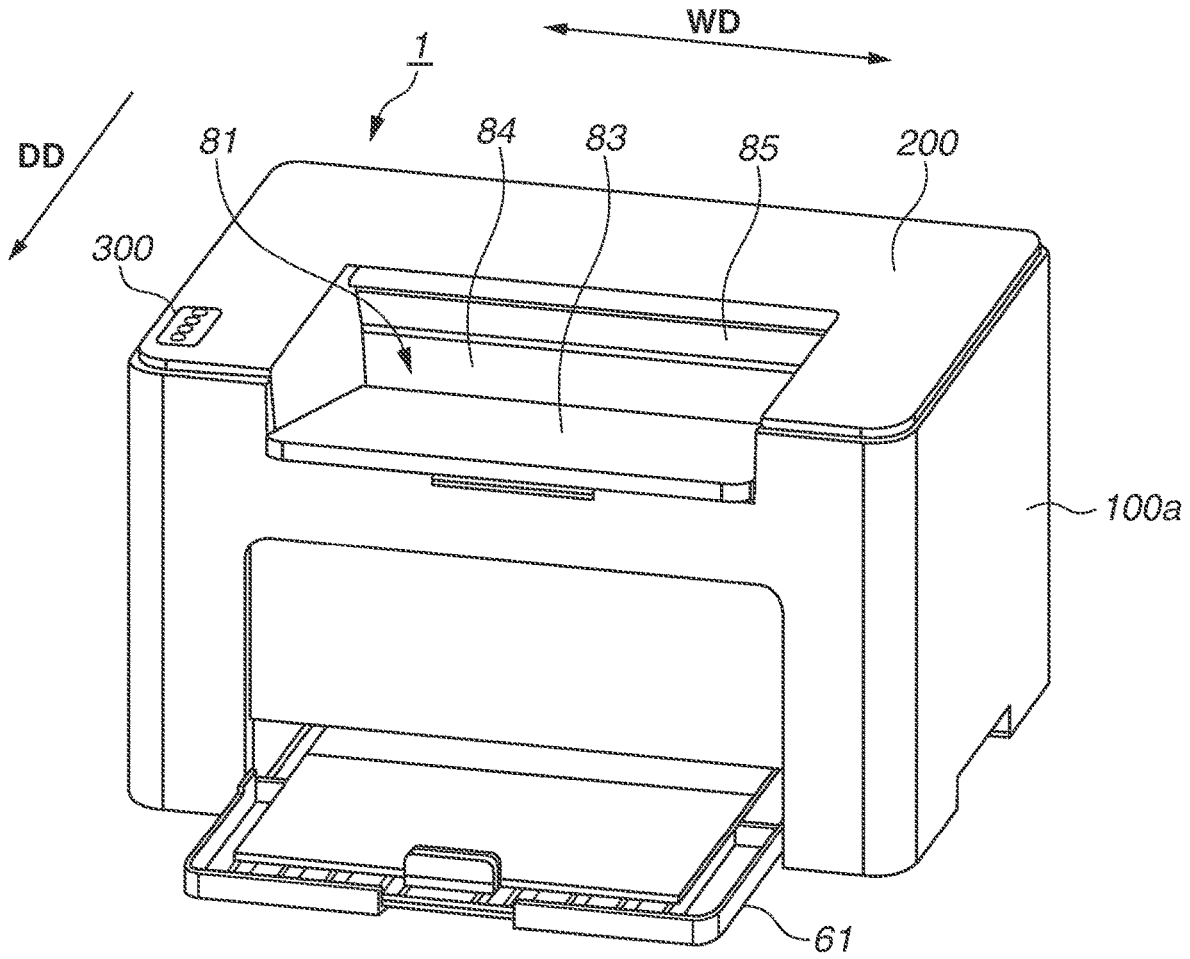
FIG. 2 is a perspective diagram of the image forming apparatus.

As illustrated in FIGS. 1A and 2, the image forming apparatus 1 includes a printer main body 100 as an apparatus main body and an operation unit 300 attached to the outer surface of the printer main body 100. The printer main body 100 includes an image forming unit 10 that forms a toner image on the recording material P and a feed unit 60 that feeds the recording material P to the image forming unit 10. The printer main body 100 further includes a fixing device 70 that fixes the image formed by the image forming unit 10 on the recording material P and the discharge roller pair 80 that ejects the recording material P with the image fixed thereon to the outside of the apparatus. The printer main body 100 also includes a control unit 360 that controls an image forming operation performed by the image forming unit 10 on the recording material P. The image forming unit 10 includes a scanner unit (not illustrated), an electrophotographic process cartridge 20, and a transfer roller 12 that transfers the image on the photoconductive drum 21 included in the process cartridge 20 onto the recording material P. The process cartridge 20 includes the photoconductive drum 21, a charging roller 22 arranged around the photoconductive drum 21, a pre-exposure device 23, and a development device 30 including the development roller 31.

The photoconductive drum 21 is a photoconductive member formed in a cylindrical shape. The photoconductive drum 21 in the present exemplary embodiment includes a photosensitive layer made of a negatively-chargeable organic photoconductive member on a drum-shaped base body made of aluminum. The photoconductive drum 21 serving as an image bearing member is rotationally driven by a motor at a predetermined process speed in a predetermined direction (the clockwise direction in FIG. 1A).

The charging roller 22 is brought into contact with the photoconductive drum 21 by a predetermined pressure-contact force to form a charging part. In addition, with application of a desired charging voltage by a high-voltage charging power source, the charging roller 22 electrically charges evenly the surface of the photoconductive drum 21 at a predetermined potential. The photoconductive drum 21 in the present exemplary embodiment is charged to a negative polarity by the charging roller 22. The pre-exposure device 23 removes the potential on the surface of the photoconductive drum 21 before the photoconductive drum 21 is rotationally moved to the charging part in order to cause stable discharge at the charging part.

The scanner unit (not illustrated) as an exposure unit irradiates the photoconductive drum 21 with laser light corresponding to the image information input from the external device using a polygon mirror to expose the surface of the photoconductive drum 21. When being exposed by the scanner unit, an electrostatic latent image is formed on the surface of the photoconductive drum 21 in accordance with the image information. The scanner unit is not limited to a laser scanner device but may be, for example, a light-emitting diode (LED) exposure device in which a plurality of LEDs is arrayed along the longitudinal direction of the photoconductive drum 21.

The development device 30 includes the development roller 31 as a developer bearing member that bears developer, a developer container 32 constituting the frame of the development device 30, and a supply roller 33 capable of supplying developer to the development roller 31. The development roller 31 and the supply roller 33 are rotatably supported by the developer container 32. The development roller 31 is arranged at an opening portion of the developer container 32 so as to face the photoconductive drum 21. The supply roller 33 is rotatably in contact with the development roller 31. The toner as developer stored in the developer container 32 serving as a storage member is applied by the supply roller 33 to the surface of the development roller 31. The supply roller 33 may not be provided if toner can be sufficiently supplied to the development roller 31.

The development device 30 in the present exemplary embodiment uses a contact development method as a developing method. Specifically, a toner layer borne by the development roller 31 comes into contact with the photoconductive drum 21 at a development part (development area) where the photoconductive drum 21 and the development roller 31 face each other. A development voltage is applied to the development roller 31 by a high-voltage developing power source. With the application of the development voltage, the toner borne by the development roller 31 is transferred from the development roller 31 onto the surface of the photoconductive drum 21 in accordance with a potential distribution on the surface of the photoconductive drum 21, so that the electrostatic latent image is developed to be a toner image. In the present exemplary embodiment, a reversal development method is adopted. Specifically, after the photoconductive drum 21 is electrically charged in the charging step, the surface area of the photoconductive drum 21 is exposed in the exposure step so that the toner adheres to the surface area of the photoconductive drum 21 where the amount of electric charge has been attenuated, thereby forming a toner image thereon.

The toner in the present exemplary embodiment has a specific weight of 1.1 and a negative polarity as a normal charging polarity. The toner particle size is distributed within a range of about 4 μm to 8 μm, and the core particle size is 6 μm. For the toner in the present exemplary embodiment, polymerized toner generated by a polymerization method is employed as an example. The toner in the present exemplary embodiment is a non-magnetic one-component developer that does not contain a magnetic component and is applied to the development roller 31 mainly by an intermolecular force or electrostatic force (image force). Alternatively, a one-component developer containing a magnetic component may be used. Some one-component developer may contain not only toner particles but also additives (for example, wax and silica fine particles) for adjusting the fluidity and charging performance of the toner. Yet alternatively, a two-component developer consisting of non-magnetic toner as a developer and a magnetic carrier may be used. In the case of using a magnetic developer, for example, a cylindrical development sleeve with a magnet arranged on the inner side thereof is used as the developer bearing member.

The developer container 32 includes a container portion 36 that contains toner supplied from a toner pack 40, as a developer supply container and a stir member 34, serving as a stir unit, arranged within the container portion 36. The stir member 34 is driven and rotated by a motor (not illustrated) to stir the toner in the developer container 32 and feed the toner to the development roller 31 and the supply roller 33. The stir member 34 also has the role of circulating residual toner that has not been used for development and removed from the development roller 31 within the developer container to keep the toner in the developer container uniform.

The configuration of the stir member 34 is not limited to the rotational type. For example, a swinging type of stir member may be adopted instead.

A development blade 35 is arranged at the opening portion of the developer container 32 where the development roller 31 is provided, and the development blade 35 regulates the amount of toner to be borne by the development roller 31. When the toner supplied to the surface of the development roller 31 passes through a portion thereof facing the development blade 35 along with the rotation of the development roller 31, the toner is formed into a uniform thin layer and charged to the negative polarity by triboelectric charging.

As illustrated in FIG. 1A, the feed unit 60 includes a front door 61 supported by the printer main body 100 in an openable/closable manner, a tray portion 62, and a pickup roller 65 configured to move upward and downward. The tray portion 62 constitutes the bottom surface of a recording material storage space that appears when the front door 61 is opened.

When being in a closed state with respect to the printer main body 100, the front door 61 covers the recording storage space. When being in an opened state with respect to the printer main body 100, the front door 61 supports the recording material P together with the tray portion 62.

Figure 3A:
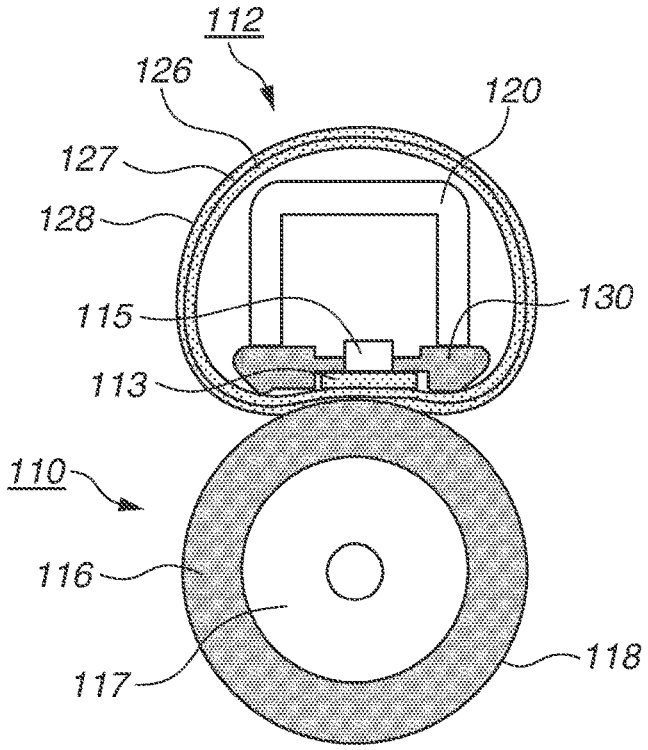
FIGS. 3A and 3B are schematic configuration diagrams of a fixing device.
Figure 3B:
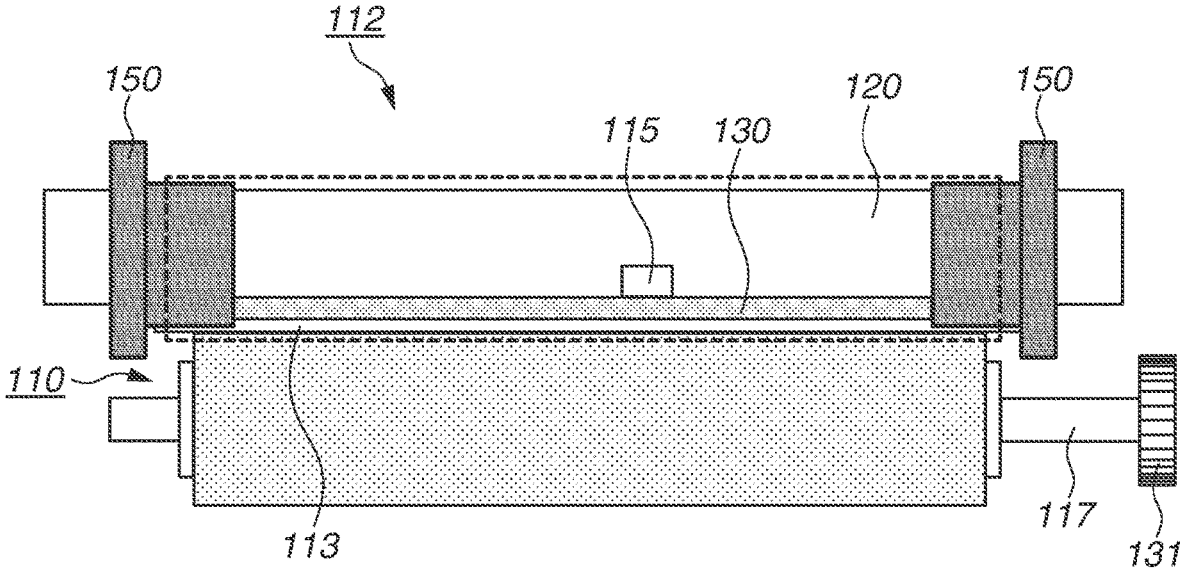

The fixing device 70 in the present exemplary embodiment will be described below. The fixing device 70 in the present exemplary embodiment is a film-heating type heating device for the purpose of shortening the starting time and reducing power consumption. FIG. 3A illustrates a schematic cross-sectional view of the fixing device 70 in the present exemplary embodiment, and FIG. 3B illustrates the fixing device 70 in a longitudinal direction when viewed from the upstream side in a conveyance direction. A fixing film 112 and a heater holder 130 are transparently illustrated so that a heater 113 can be clearly seen.

The fixing device 70 in the present exemplary embodiment is configured such that the heater 113 including resistance heating elements and a substrate on which heating elements are arranged is held by the heater holder 130, and that the fixing film 112 in the form of an endless belt is provided around the heater holder 130. The heater holder 130 is desirably made of a material having a low-heat capacity which is less likely to draw heat from the heater 113, and in the present exemplary embodiment, the heater holder 130 is made of a liquid crystal polymer (LCP) that is a heat-resistance resin. The heater holder 130 is supported by an iron stay 120 from the side opposite to the heater 113 to ensure strength. The stay 120 is pressurized by pressure springs (not illustrated) from both longitudinal end portions. As illustrated in FIG. 3A, the heater 113 is in contact with the inner surface of the fixing film 112 to form an inner nip therebetween where the fixing film 112 is heated from the inner side. A pressure roller 110 faces the heater 113 with the fixing film 112 in between to form a fixing nip.

The pressure roller 110 is driven by a force of pressure springs received by bearings (not illustrated) provided at both end portions of a metal core 117 and by a driving force received from a driving source (not illustrated) by a drive gear 131 at an end portion of the metal core 117. When the pressure roller 110 is driven, the fixing film 112 rotates following the pressure roller 110 by receiving the driving force from the pressure roller 110 at the fixing nip. The fixing film 112 may become skewed toward either the right or left in the longitudinal direction of the heater 113. Thus, as illustrated in FIG. 3B, fixing flanges 150 are arranged at both ends of the fixing film 112 to prevent the skewing to one side. The fixing flanges 150 are fitted and fixed onto the stay 120. The fixing film 112 is internally supported at the both ends by the fixing flanges 150.

The fixing film 112 in the present exemplary embodiment has an outer diameter of 20 mm in an undeformed cylindrical state, and has a multi-layer structure in the thickness direction of the film. The fixing film 112 has a layer structure formed of a base layer 126 for maintaining the strength of the film, a conductive primer layer 127, and a mold release layer 128 for reducing adhesion of dirt to the surface. The base layer 126 needs to be heat-resistant in order to receive heat from the heater 113 and also needs to be strong in order to slide on the heater 113. Thus, the material of the base layer 126 is desirably a metal such as stainless used steel (SUS) or nickel, or a heat-resistance resin such as polyimide. A metal is stronger than a resin and can be formed into a thin film, and is also high in heat conductivity which allows the heat from the heater 113 to be easily transferred to the surface of the fixing film 112. On the other hand, a resin is smaller in specific gravity than a metal and thus has a small heat capacity that is advantageous in heating up easily. In addition, a resin can be formed into a thin film inexpensively by coating and molding.

In the present exemplary embodiment, the material of the base layer 126 in the fixing film 112 is a polyimide resin.

A carbon-based filler is added to the material for improvement in heat conductivity and strength. A thinner base layer 126 is more likely to transfer the heat from the heater 113 to the surface of the fixing film 112. However, if the base layer 126 is formed to be excessively thin, the strength will decrease. Considering the balance between heat conductivity and strength, the thickness of the base layer 126 is desirably about 15 μm to 100 μm, and in the present exemplary embodiment, the thickness of the base layer 126 is set to 60 μm. The conductive primer layer 127 is made of a polyimide resin or a fluorine resin to which a carbon or the like is added to lower the resistance. While the recording material P is being conveyed through the fixing nip, an exposed portion of the conductive primer layer 127 is grounded to stabilize the potential of the fixing film 112.

The material of the mold release layer 128 is desirably a fluorine resin such as a perfluoro alkoxy resin (PFA), a polytetrafluoroethylene resin (PTFE), or a tetrafluoroethylene-hexafluoropropylene resin (FEP). In the present exemplary embodiment, among the fluorine resins, a PFA excellent in mold-releasability and heat resistance is used, and a conductive material is dispersed in the mold release layer 128 to moderate the resistance. The mold release layer 128 may be formed by covering a tube or coating the surface with a coating material. In the present exemplary embodiment, the mold release layer 128 is formed by using a coat excellent in thin-wall moldability. A thinner mold release layer 128 is more likely to transfer the heat from the heater 113 to the surface of the fixing film 112. However, an excessively thin mold release layer 128 will deteriorate in durability. Considering the balance between them, the thickness of the mold release layer 128 is desirably about 5 μm to 30 μm, and in the preset exemplary embodiment, the thickness of the release layer 128 is set to 10 μm.

The pressure roller 110 in the present exemplary embodiment has an outer diameter of 14 mm and includes an elastic layer 116 made of silicon rubber in a thickness of 2.5 mm on the iron metal core 117 having an outer diameter of 9 mm. The elastic layer 116 is made of a heat-resistance silicon rubber or fluorine rubber, and in the present exemplary embodiment, the elastic layer 116 is made of a silicon rubber. The outer diameter of the pressure roller 110 is about 10 to 50 mm. The pressure roller 110 needs to have a moderate outer diameter because a smaller outer diameter can suppress heat capacity but an excessively small outer diameter will decrease the width of the fixing nip. Considering the balance between them, the outer diameter of the pressure roller 110 in the present exemplary embodiment is set to 14 mm. The elastic layer 116 also needs to have a moderate wall thickness because an excessively thin wall will cause the heat to move to the metal core. Considering the balance between them, in the present exemplary embodiment, the thickness of the elastic layer 116 is set to 2.5 mm.

A mold release layer 118 made of a perfluoro alkoxy resin (PFA) is formed on the elastic layer 116. Like the mold release layer 128 of the fixing film 112, the mold release layer 118 may be formed by covering a tube or coating the surface with a coating material. In the present exemplary embodiment, the mold release layer 118 is formed of a durable tube having a film thickness of 20 μm. The material of the mold release layer 118 may be, instead of the PFA, a fluorine resin such as PTFE or FEP, or fluorine resin or silicon rubber high in mold releasability. A lower surface hardness of the pressure roller 110 allows forming a wide fixing nip under light pressure, but an excessively low surface hardness will deteriorate the durability. Thus, considering the balance between them, in the present exemplary embodiment, the surface hardness of the pressure roller 110 is set to 40° based on Asker-C hardness (600-g load). The pressure roller 110 rotates at a surface moving speed of 150 mm/sec.

The heater 113 in the present exemplary embodiment is a typical heater used in a film-heating type heating device, and has resistance heating elements arranged in series on a ceramic substrate. The heater 113 is formed by applying silver-palladium (Ag/Pd) resistance heating elements at a height of 10 μm by screen printing on the surface of an alumina substrate having a width of 6 mm and a thickness of 1 mm and covering the substrate with 50-μm thick glass as a heating element protective layer. As illustrated in FIG. 3B, in order to detect the temperature of the ceramic substrate, a temperature detection element (thermistor) 115 is arranged on the side of the heater 113 opposite to the side on which the resistance heating elements are arranged. Electric power to be supplied to the resistance heating elements is controlled by controlling the target temperature in accordance with a signal from the temperature detection element 115. The fixing temperature by the heater 113 is set to 180 degrees in Celsius for plain paper in the present exemplary embodiment.

A temperature fuse (not illustrated) as a safety element is arranged on the surface of the heater 113 where the temperature detection element 115 arranged in order to, in the event of abnormal heat generation by the heater 113, shut off the electric power supplied to the heater 113. The heater 113 is connected to a commercial power source via the temperature fuse. When the heater 113 abnormally generates heat and reaches a high temperature, the temperature fuse blows to shut off the supply of electric power from the commercial power source to the heater 113.

Image Forming Operation

Next, an image forming operation by the image forming apparatus 1 will be described. When an instruction for image formation is input from an external device (not illustrated), the image forming unit 10 starts an image formation process based on the image information input from the external device. The scanner unit (not illustrated) irradiates the photoconductive drum 21 with laser light based on the input image information. The photoconductive drum 21 is electrically charged by the charging roller 22 and is irradiated with the laser light, so that an electrostatic latent image is formed on the photoconductive drum 21. The electrostatic latent image formed on the photoconductive drum 21 is developed as an image by toner on the development roller 31.

In parallel to the image formation process, the pickup roller 65 of the feed unit 60 feeds the recording material P stacked on the front door 61 and the tray portion 62. The recording material P is conveyed by the pickup roller 65 to the registration roller pair 15. When the recording material P hits the nip of the registration roller pair 15, the skew is corrected. Then, the registration roller pair 15 conveys the recording material P toward the transfer nip formed by the transfer roller 12 and the photoconductive drum 21 in synchronization with the timing of transfer of the image on the photoconductive drum 21.

When a transfer voltage is applied from a high-voltage transferring power source, the transfer roller 12 as a transfer unit transfers the image formed on the photoconductive drum 21 onto the recording medium P. The recording material P with the image transferred thereon is conveyed to the fixing device 70. While the recording material P is conveyed through the fixing nip in the fixing device 70, the recording material P is heated and pressurized. Accordingly, the toner particles become melted and then solidified to fix the image to the recording material P. The recording material P having passed through the fixing device 70 is discharged by the discharge roller pair 80 as a discharge unit. The recording material P is discharged to the outside of the image forming apparatus 1 via a discharge port 85, and stacked on a discharge tray 81 arranged on the upper part of the printer main body 100.

Supply of Toner from Toner Pack to Development Device

Figure 1B:
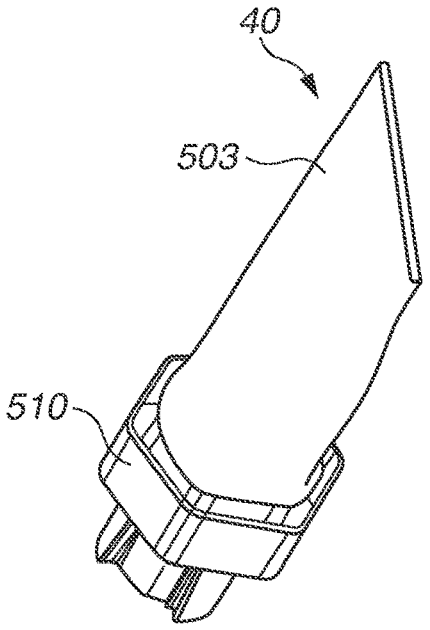
FIG. 1B is a schematic configuration diagram of a toner pack.

Next, the supply of toner from the toner pack 40 to the development device 30 will be described. The toner pack 40 as a supply container storing the toner is attachable to and detachable from the attachment port of the image forming apparatus 1. As illustrated in FIG. 1B, the toner pack 40 includes an attachment part 510 and a pouch 503. The pouch 503 is a flexible container capable of storing toner.

The development device 30 includes a supply port 32*a* that is an attachment part to which the attachment part 510 of the toner pack 40 is attachable. The supply port 32*a* is located at a position inside the main body, i.e., on the inner side of the exterior of the image forming apparatus 1. The toner is supplied to the developer container 32 of the development device 30 via the supply port 32*a*. The supply port 32*a* can allow the toner pack 40 to attach to and detach from the image forming apparatus 1, and determines the position of the toner pack 40.

In order to attach the toner pack 40 to the image forming apparatus 1, the user moves and opens the cover 83 to expose the supply port 32*a*. As illustrated in FIG. 1A, the cover 83 is movable between a first position (dashed line) where the cover 83 covers the internal part of the image forming apparatus 1 and a second position (solid line) where the cover 83 allows access to the internal part of the image forming apparatus 1 from the outside. In other words, the first position is a position that causes the supply port 32*a* to be covered and disables access to the supply port 32*a* from the outside, and the second position is a position that causes the supply port 32*a* to be open and enables access to the supply port 32*a* from the outside. When the cover 83 moves to the second position, the user can attach the toner pack 40 to the supply port 32*a* or remove the toner pack 40 from the supply port 32*a*. The cover 83 serving as an open/close member rotates around a hinge on the left of the cover 83, but the configuration of the cover 83 is not limited thereto. For example, the cover 83 may be a slide door. The cover 83 may be a double door that is openable using hinges at opposing sides of an opening in the image forming apparatus main body. Various open/close mechanisms can be applied to the cover 83.

As illustrated in FIG. 1A, when the toner pack 40 is attached to the supply port 32*a* with the cover 83 at the second position, the toner is supplied from the toner pack 40 to the developer container 32 of the development device 30. More specifically, when the toner pack 40 is attached to the supply port 32*a*, the toner pack 40 and the developer container 32 communicate with each other so that the toner enclosed in the toner pack 40 moves to the developer container 32 under its own weight or by the user pressing the toner pack 40.

Furthermore, as illustrated in FIG. 1A, when the toner pack 40 is attached to the supply port 32*a*, the upper part of the toner pack 40 as seen in the direction of gravitational force protrudes outwardly from the exterior of the image forming apparatus main body (upward in the direction of gravitational force). This eliminates the need to store the whole toner pack 40 in the image forming apparatus 1, thereby achieving downsizing of the image forming apparatus 1. The supply port 32*a* is located at a position where a path of laser light emitted from the scanner unit (not illustrated) is not blocked.

Characteristics of Toner

The toner stored in the developer container 32 has a particle size distribution. The toner is applied to the development roller 31 in increasing order of particle size. This is because toner with a smaller particle size is more susceptible to an intermolecular force and an electrostatic force (image force). Thus, the toner stored in the developer container 32 has a tendency to be used in such a manner that toner with a smaller particle size is used first, and toner with a larger particle size is left inside.

When the toner applied to the development roller 31 passes through the portion thereof facing the development blade 35 along with the rotation of the development roller 31, the toner is regulated such that the amount of electric charge becomes a predetermined amount. The toner with a smaller particle size has a larger amount of electric charge because the surface area per unit weight is larger than the toner with a larger particle size. Therefore, the amount of toner with a larger particle size applied to the development roller 31 is larger than the amount of toner with a smaller particle size applied to the development roller 31.

From the above, as the toner in the developer container 32 is used for image formation, the proportion of the toner with a relatively large particle size in the developer container 32 increases. When the proportion of the toner with a larger particle size increases, the amount of toner applied to the development roller 31 tends to gradually increase as compared to the initial stage. When the amount of toner applied to the development roller 31 increases, the amount of toner for developing an electrostatic latent image also increases. Even if, for example, the electrostatic latent image to be formed on the photoconductive drum 21 has the same density, the amount of toner for developing the electrostatic latent image increases in the case where a larger amount of toner is applied to the development roller 31.

State of Toner Being Supplied

Figure 4A:
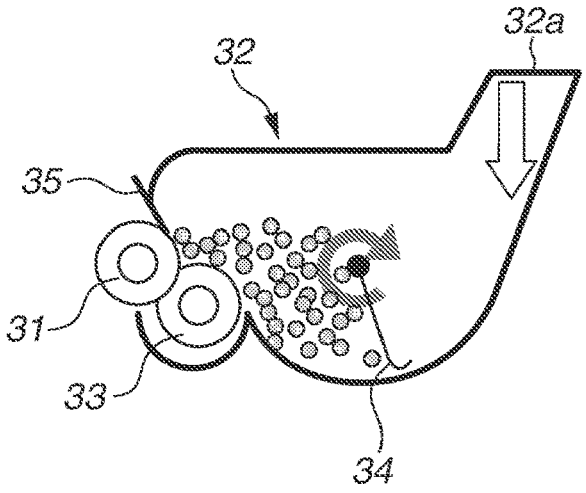
FIGS. 4A and 4B are diagrams illustrating toner in a developer container.
Figure 4B:
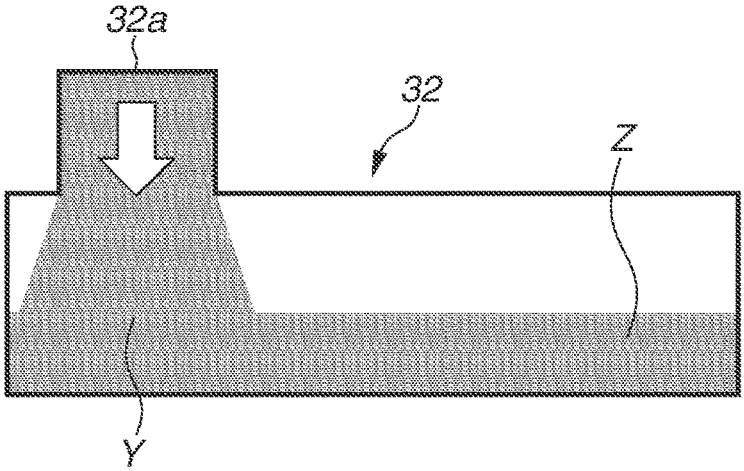
Figure 4C:
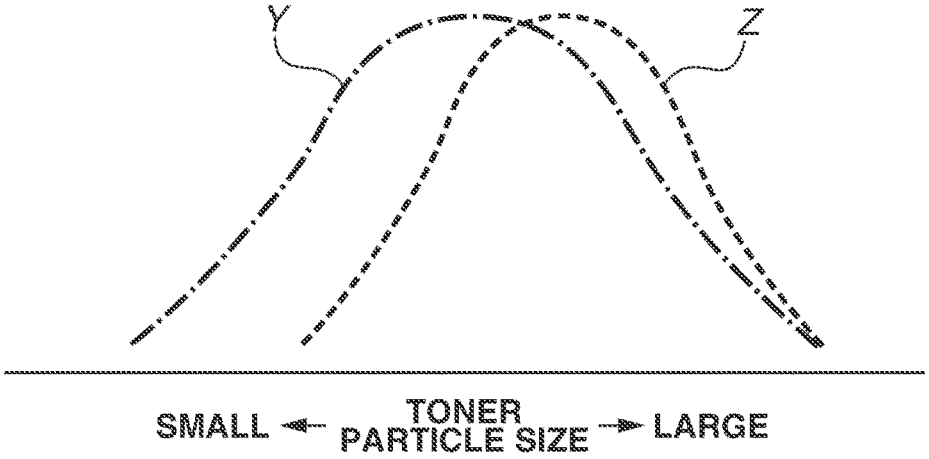
FIG. 4C is a diagram illustrating toner particle size distributions.

Next, FIGS. 4A to 4C illustrate a flow of new toner being supplied from the toner pack 40 to the developer container 32. FIG. 4A is a view of the developer container 32 when seen from the same direction as illustrated in FIG. 1A. The toner supplied from the toner pack 40 enters the developer container 32 and is conveyed by the stir member 34 toward the development roller 31.

FIG. 4B is a view of the developer container 32 as seen from the direction indicated by an arrow X in FIG. 1A. The toner supplied from the toner pack 40 accumulates directly under the supply port 32*a*. The stir member 34 rotates to flatten the toner little by little so that the toner is moved in the width direction of the recording material P orthogonal to the conveyance direction of the recording material P. However, immediately after the supply of the toner, the toner is not likely to move to a position Z and the vicinity thereof from the supply port 32*a* in the width direction.

FIG. 4C illustrates an example of toner particle size distributions immediately after toner supply. The particle size distributions in FIG. 4C are standardized. The width of the particle size distribution at the position Z and the vicinity thereof is about 6 μm to 8 μm. This is because the toner with a relatively small particle size is used first for development in the image formation before the toner supply, and the toner with a relatively large particle size is left at the position Z and the vicinity thereof.

On the other hand, the width of the particle size distribution at a position Y and the vicinity thereof immediately under the supply port 32*a* is about 4 μm to 8 μm. This is because the supply of the new toner has increased the amount of toner with a smaller particle size at the position Y and the vicinity thereof than at the position Z and the vicinity thereof. Thus, when the electrostatic latent image formed on the photoconductive drum 21 is developed with the toner in this state, the resultant image has a larger amount of toner applied at the position Z and the vicinity thereof than an amount of toner applied at the position Y and the vicinity thereof even if the electrostatic latent image has the same density.

Control of Fixing Temperature

The fixing device 70 detects the temperature of the heater 113 by the temperature detection element 115 and performs feedback control to keep the fixing temperature at a predetermined target temperature. If a change in the amount of toner changes as described above, the quantity of heat drawn from the fixing device 70 in fixing the image formed on the recording material P also changes. Thus, even in such a case where the amount of toner changes, a fixing failure can be prevented by detecting the temperature of the heater 113 by the temperature detection element 115 and performing feedback control to keep the fixing temperature at the target temperature.

Figure 5:
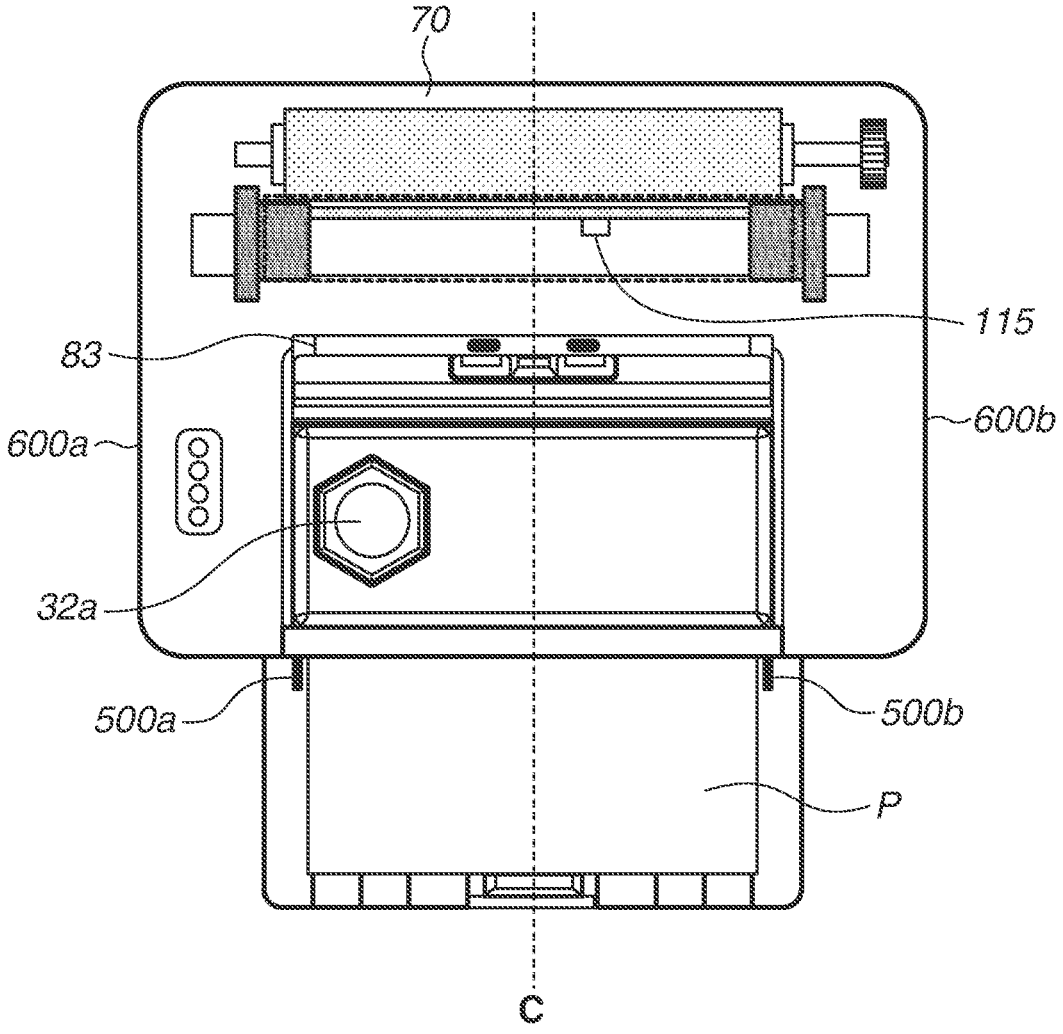
FIG. 5 is a diagram illustrating positions of a supply port and a temperature detection element.

In the present exemplary embodiment, the supply port 32*a* and the temperature detection element 115 of the fixing device 70 are arranged in a positional relationship as illustrated in FIG. 5. That is, if, with a conveyance center C in the width direction of the recording material P illustrated in FIG. 5 as a boundary, one area is designated as a first area and the other area is designated as a second area in the width direction of the recording material P, the supply port 32*a* is arranged in the first area. The temperature detection element 115 is arranged in the second area different from the first area. The conveyance center C in the width direction of the recording material P refers to a center part between width regulation members 500*a* and 500*b* that regulate the width direction of the recording material P stacked on the front door 61 and the tray portion 62. That is, when the recording material P is regulated by the width regulation members 500*a* and 500*b*, the conveyance center C is located at the same distance from the width regulation members 500*a* and 500*b* in the width direction of the recording material P.

In this example, the area is divided with reference to the conveyance center C in the width direction of the recording material P. However, the reference is not limited to the conveyance center C. For example, the area may be divided with reference to the center in the longitudinal direction of the heater 113. In this case, if one divided area is designated as a third area and the other divided area is designated as a fourth area, the supply port 32*a* is arranged in the third area and the temperature detection element 115 is arranged in the fourth area different from the third area. In this case, the conveyance center C in the width direction of the recording material P and the center in the longitudinal direction of the heater 113 do not necessarily need to coincide with each other. It is sufficient if the supply port 32*a* is arranged in one area and the temperature detection element 115 is arranged in the other area.

Accordingly, for another example, the area may be divided with reference to a longitudinal center of the resistance heating elements included in the heater 113. In this case, if one divided area is designated as a fifth area and the other divided area is designated as a sixth area in the longitudinal direction of the resistance heating elements, the supply port 32*a* is arranged in the fifth area and the temperature detection element 115 is arranged in the sixth area different from the fifth area. In this case, the conveyance center in the width direction of the recording material P and the center in the longitudinal direction of the resistance heating elements do not necessarily need to coincide with each other. It is sufficient if the supply port 32*a* is arranged in one area and the temperature detection element 115 is arranged in the other area.

Yet alternatively, the arrangement of the supply port 32*a* and the temperature detection element 115 may be represented by, for example, distances from an outer wall (side wall) 600*a* and an outer wall (side wall) 600*b* of the image forming apparatus 1. If an outer wall on one side of the image forming apparatus 1 in the longitudinal direction of the heater 113 is a first outer wall and an outer wall on the other side is a second outer wall, the supply port 32*a* is arranged at a position closer to the second outer wall than the first outer wall, and the temperature detection element 115 is arranged at a position farther from the second outer wall than the first outer wall.

A description will be given of the reason why the supply port 32*a* and the temperature detection element 115 are desirably arranged at different positions in the width direction of the recording material P or in the longitudinal direction of the heater 113, serving as a first direction, as described above. As described above with reference to FIG. 4, when the toner is supplied from the toner pack 40, the proportion of the toner having been stored in the developer container 32 before the supply, that is, the proportion of the toner with a large particle size increases at the position relatively far from the supply port 32*a* in the first direction.

As described above, when the amount of toner with a large particle size increases, the toner bearing amount becomes larger, and the temperature for fixing becomes higher. Arranging the temperature detection element 115 in the area where the temperature for fixing may increase makes it possible to prevent occurrence of a fixing failure by performing feedback control on the toner bearing amount that temporarily becomes uneven after the toner supply.

Advantageous Effects of the Present Exemplary Embodiment

As a comparative example, in a configuration where the temperature detection element 115 and the supply port 32*a* are arranged in the same area with reference to the conveyance center C of the recording material P in the first direction, the toner fixability after toner supply was evaluated.

Image formation was performed at a printing rate of 4% when the filing amount of initial toner in the developer container 32 is 100 g. When the amount of toner in the developer container 32 reached 70 g, 50 g, and 30 g, toner of 30 g was additionally supplied through the supply port 32*a* at each point of time. Immediately after the toner supply, the fixability was evaluated as below.

The fixability was evaluated in a low-temperature and low-humidity environment (temperature 15 degrees in Celsius and humidity 10%) in which the toner is cooled and the toner bearing amount is likely to be affected. The recording material used for the evaluation was Xerox® Vitality® Multipurpose Paper (letter size, 20 lb) that had been left for two days under a low-temperature and low-humidity environment. An evaluation image of a full-page print pattern was continuously formed on twenty sheets of paper. After the processing of the twenty sheets, the printing sessions without a fixing issue were rated as good (indicated as "0" in FIG. 6A), and the printing session with toner peeling found on at least one sheet was rated as not good (indicated as "X" in FIG. 6A). FIG. 6A indicates evaluation results. FIG. 6B indicates toner bearing amounts per unit area of recording materials before the toner supply.

As illustrated in FIG. 6A, no fixing failure occurred in the configuration of the present exemplary embodiment because the temperature detection element 115 was arranged in the area where the toner bearing amount on the recording material P might increase and the fixing temperature was controlled in accordance with the result of temperature detection by the temperature detection element 115.

In the comparative example, no fixing failure occurred when the amount of toner stored in the developer container 32 reached 70 g and 50 g. However, when the amount of toner stored in the developer container 32 reached 30 g, slight toner peeling was observed during image formation when the image was formed on the first and second sheets. When the amount of toner stored in the developer container 32 reached 70 g and 50 g, the toner bearing amount in the first direction was not so uneven after the supply of the new toner, and thus no fixing failure occurred when the fixing temperature was controlled in the configuration of the comparative example. However, when the amount of toner stored in the developer container 32 reached 30 g, the toner bearing amount became increasingly uneven due to the supply of the new toner, and a fixing failure occurred under control of the fixing temperature in the configuration of the comparative example. In the comparative example, since the temperature detection element 115 was arranged in the same area as the supply port 32*a*, the fixing temperature was controlled at the time of supply of the new toner through the detection of the temperature in the area with a relatively small toner bearing amount.

Thus, in the area with a relatively large toner bearing amount, the heat quantity for melting the toner was insufficient to cause toner peeling.

As above, arranging the supply port 32*a* and the temperature detection element 115 at different areas in the first direction can prevent occurrence of a fixing failure.

Hereinafter, a second exemplary embodiment will be described. The present exemplary embodiment will be described using a configuration that includes a temperature detection element 115*a* as a main thermistor and temperature detection elements 115*b* and 115*c* as sub thermistors for end portion temperature rise control. Detailed description of components similar to those of the first exemplary embodiment, such as an image forming apparatus, will be omitted here.

Figure 7A:
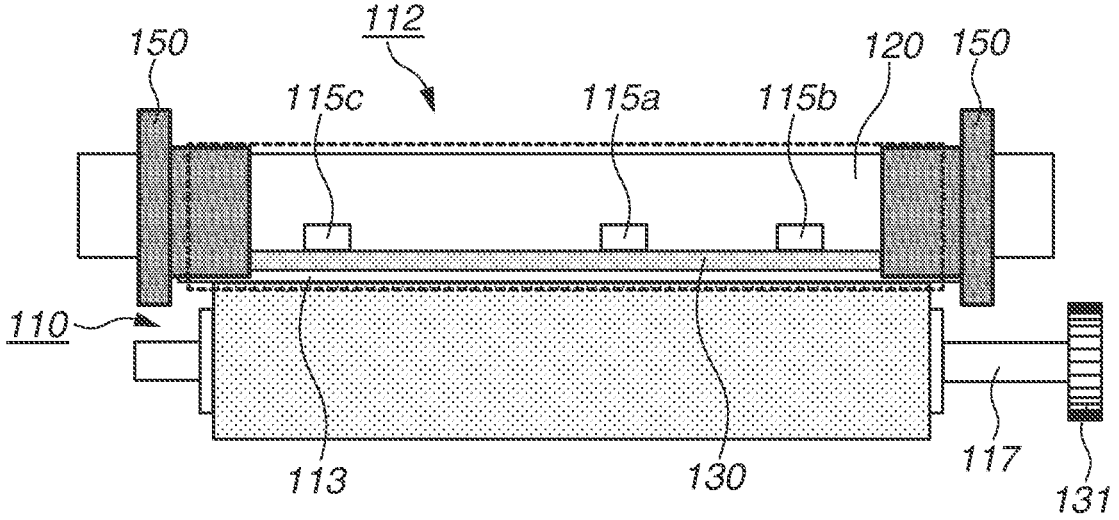
FIGS. 7A and 7B are schematic configuration diagrams of the image forming apparatus.
Figure 7B:
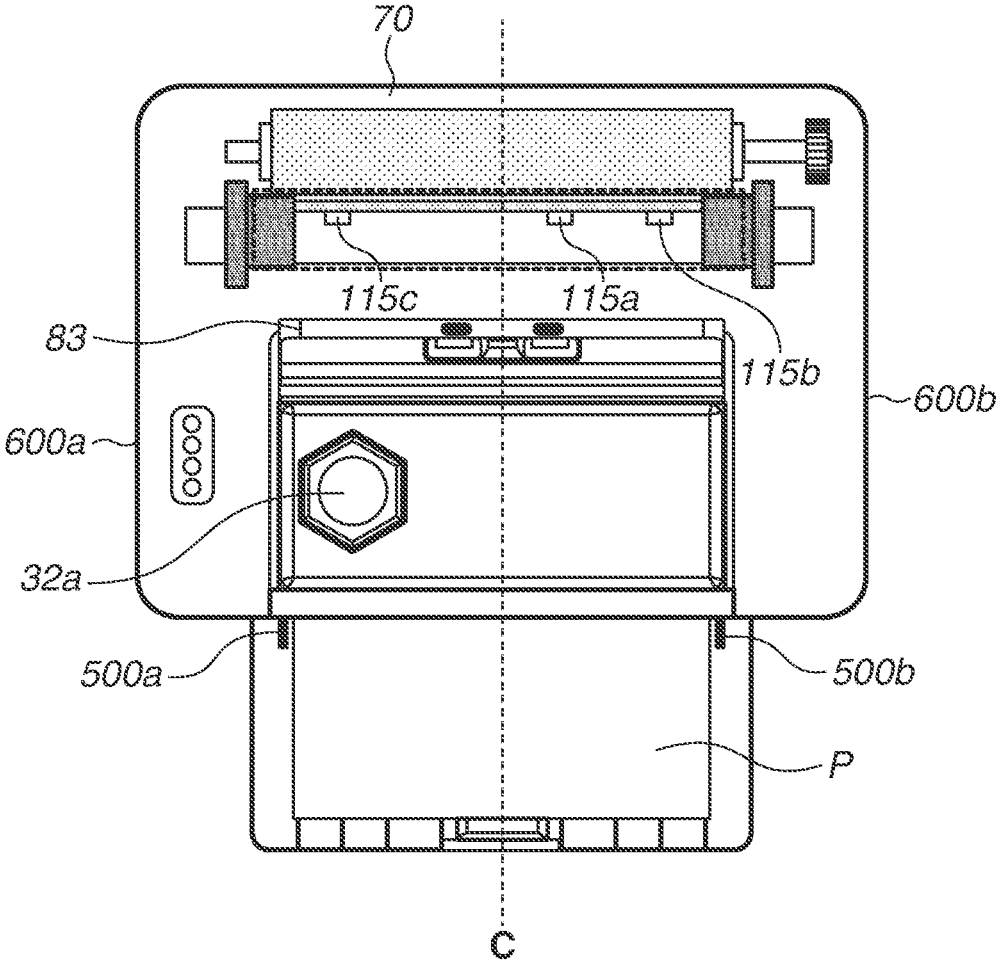

FIGS. 7A and 7B are diagrams illustrating a configuration of a fixing device in the present exemplary embodiment. As illustrated in FIGS. 7A and 7B, in addition to the temperature detection element 115*a* as a first temperature detection unit, a temperature detection element 115*b* as a second temperature detection unit and a temperature detection element 115*c* as a third temperature detection unit are arranged on the back side of a heater 113. The temperature detection element 115*a* is similar to the temperature detection element 115 described above in the first exemplary embodiment and is a main thermistor that detects the temperature of the heater 113 and provide a feedback to the control of the fixing temperature.

The temperature detection elements 115*b* and 115*c* are arranged at both end portions of the heater 113 in a first direction that is the longitudinal direction of the heater 113. This is intended to detect a temperature rise at the end portions of the heater 113 if toner is fixed on a recording material P having a short width. Resistance heating elements of the heater 113 are arranged long enough to perform fixing on a recording material P having the maximum width among the usable recording materials P. Thus, when fixing is performed on a recording material P having a shorter width than the maximum possible width, no heat is drawn by the recording material P in the areas through which the recording material P does not pass, and thus the temperature in the areas through which the recording material P does not pass will increase. The temperature detection elements 115*b* and 115*c* are arranged at positions through which the recording material P does not pass so that the temperatures in the areas through which the recording material P does not pass can be detected. If the results of detection by the temperature detection elements 115*b* and 115*c* are higher than a predetermined temperature, it is determined that the end portions have a temperature rise. Then, control is performed such that the intervals of conveyance of the recording materials P are increased to reduce a throughput and eliminate a temperature rise at the end portions.

Fixing Temperature Control

As illustrated in FIG. 7B, in the present exemplary embodiment as well, a supply port 32*a* and the temperature detection element 115*a* are arranged in different areas in the first direction. Thus, when the toner is supplied from a toner pack 40, the proportion of the toner having been stored in a developer container 32 before the toner supply, that is, the proportion of the toner with a large particle size becomes large at a position relatively far from the supply port 32*a* in the first direction. As described above, when the amount of toner with a large particle size increases, the toner bearing amount becomes larger, and the temperature for fixing then becomes higher. Arranging the temperature detection element 115*a* in the area where the temperature for fixing may increase makes it possible to prevent occurrence of a fixing failure by performing feedback control on a temporarily uneven bearing amount after the toner supply.

Advantageous Effects of the Present Exemplary Embodiment

As in the first exemplary embodiment, the fixability after toner supply was evaluated. No fixing failure occurred in the present exemplary embodiment because the temperature detection element 115*a* was arranged in the area where the toner bearing amount on the recording material P might increase and the fixing temperature was controlled in accordance with the result of temperature detection by the temperature detection element 115*a*.

Hereinafter, a third exemplary embodiment will be described. In the present exemplary embodiment, a configuration of a heater 113 including resistance heating elements different in length in the longitudinal direction will be described. Detailed description of components similar to those of the first and second exemplary embodiments, such as an image forming apparatus, will be omitted here.

Figure 8A:
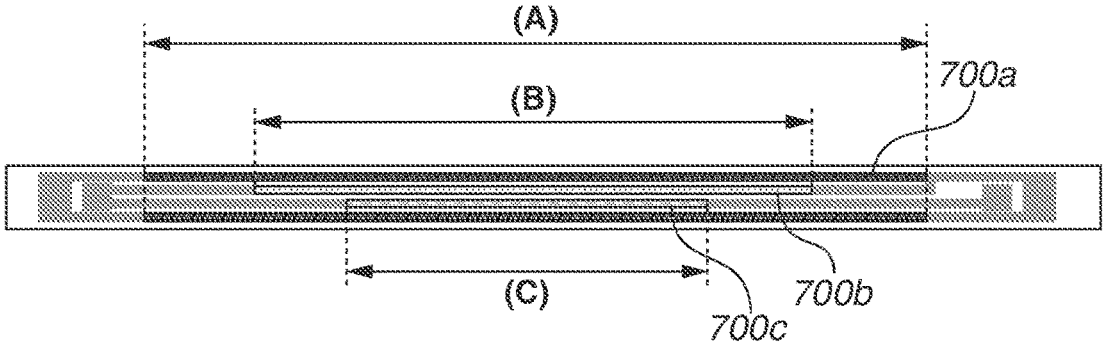
FIGS. 8A to 8C are schematic configuration diagrams of the image forming apparatus.
Figure 8B:
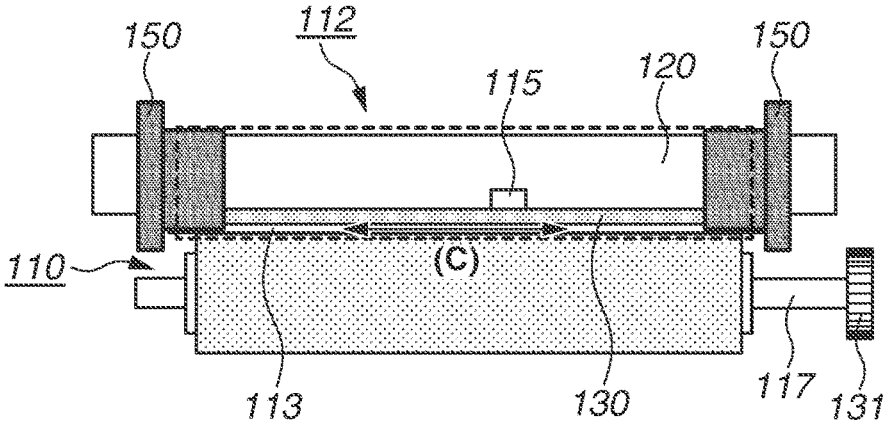
Figure 8C:
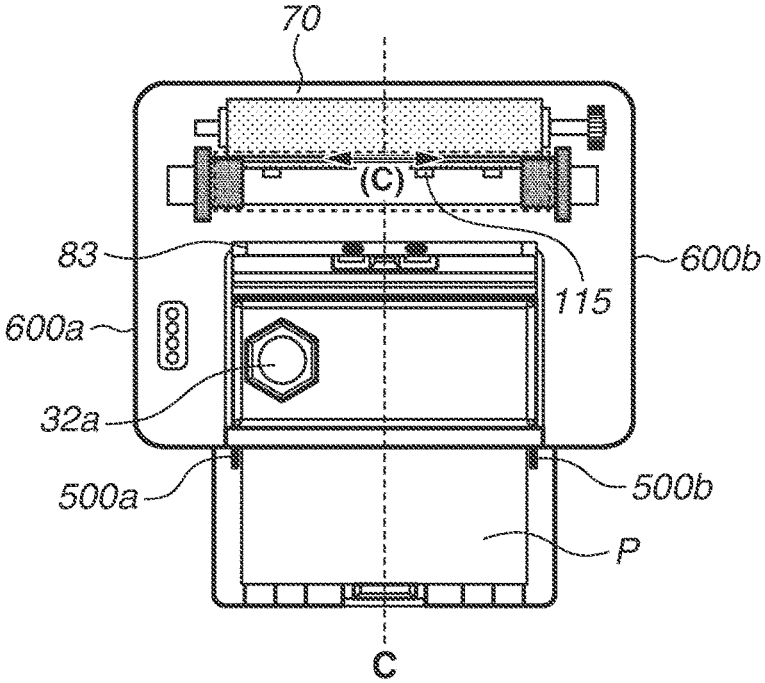

FIGS. 8A to 8C are diagrams illustrating a configuration of a fixing device and the heater 113 in the present exemplary embodiment. As illustrated in FIG. 8A, three resistance heating elements arranged in the heater 113 of the present exemplary embodiment are different in length in the longitudinal direction. The length of the longest first resistance heating element 700*a* is indicated by an arrow (A) in FIG. 8A, the length of the next longest second resistance heating element 700*b* is indicated by arrow (B), and the length of the shortest third resistance heating element 700*c* is indicated by arrow (C).

In accordance with the width of the recording material P on which an image is to be formed, the fixing is performed by selecting, among the resistance heating elements, one to supply electrical power. The first resistance heating element corresponds to a recording material P of A4 or a letter size (LTR), the second resistance heating element corresponds to a recording material P of B5 or an executive size (EXE), and the third resistance heating element corresponds to a recording material P of A6 or a size of 4×6 inches. A temperature detection element 115 in the present exemplary embodiment is arranged at a position within the area of the third resistance heating element as illustrated in FIG. 8B so that, in a case of performing the fixing using any of the resistance heating elements, the detection results can be fed back to the control of the fixing temperature. That is, the temperature detection element 115 is arranged at a position overlapping all of the resistance heating elements as viewed from the thickness direction of the heater 113.

Control of Fixing Temperature

As illustrated in FIG. 8C, in the present exemplary embodiment as well, a supply port 32*a* and the temperature detection element 115 are arranged in different areas in a first direction. Thus, when the toner is supplied from a toner pack 40, the proportion of the toner having been stored in a developer container 32 before the toner supply, that is, the proportion of the toner with a large particle size becomes large at a position relatively far from the supply port 32*a* in the first direction. As described above, when the amount of toner with a large particle size increases, the toner bearing amount becomes larger, and the temperature for fixing then becomes higher. Arranging the temperature detection element 115 in the area where the temperature for fixing may increase makes it possible to prevent occurrence of a fixing failure by performing feedback control on a temporarily uneven bearing amount after the toner supply.

Further, the temperature detection element 115 is arranged at a position within the area of the third resistance heating element so that, if the fixing is performed using any of the three resistance heating elements different in length in the longitudinal direction, the detection results can be fed back to the control of the fixing temperature. Thus, it is possible to prevent occurrence of a fixing failure if any of the resistance heating elements is used to perform fixing.

Advantageous Effects of the Present Exemplary Embodiment

As in the first and second exemplary embodiments, the fixability after toner supply was evaluated. No fixing failure occurred in the present exemplary embodiment because the temperature detection element 115 was arranged in the area where the toner bearing amount on the recording material P might increase and the fixing temperature was controlled in accordance with the result of temperature detection by the temperature detection element 115.

According to the configurations of the exemplary embodiments, it is possible to prevent occurrence of a fixing failure even if new toner is supplied to a developer container where old toner is still left.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-206316, filed Dec. 11, 2020, which is hereby incorporated by reference herein in its entirety.

What is claimed is:

1. An image forming apparatus comprising:

an image bearing member;

a developer bearing member configured to develop an electrostatic latent image formed on the image bearing member as an image a using developer;

a frame configured to support the developer bearing member and including a storage portion for storing the developer, where the stored developer is to be supplied to the developer bearing member and the frame includes an attachment part in which a supply container with developer enclosed in the supply container is attachable to and detachable from the attachment part;

a transfer unit configured to transfer the developed image onto a recording material;

a fixing unit configured to fix the image to the recording material;

a first temperature detection unit configured to detect a temperature of the fixing unit;

a cover movable between a first position where the attachment part is covered and disables access from outside and a second position where the attachment part is exposed and enables access from outside; and a control unit configured to control supply of electric power to the fixing unit based on a result of detection by the first temperature detection unit, wherein the recording material with the image formed on the recording material is stacked on the cover in a state where the cover is in the first position, wherein the supply container is configured such that, when the supply container is attached to the attachment part when the cover is located at the second position, the developer enclosed in the supply container is movable to the storage portion under a weight of the enclosed developer, wherein the cover is movable from the second position to the first position in a state where the supply container is detached from the attachment part, and wherein, with reference to a conveyance path having a center in a width direction of the recording material that is orthogonal to a conveyance direction of the recording material and in a case where an area on one side of the conveyance path center is designated as a first area and the area on the other side of the conveyance path center is designated as a second area, the attachment part is arranged in the first area and the first temperature detection unit is arranged in the second area.

2. The image forming apparatus according to claim 1, further comprising:

a second temperature detection unit configured to detect a temperature of the fixing unit; and a third temperature detection unit configured to detect a temperature of the fixing unit, wherein the second temperature detection unit is arranged in the second area, and the third temperature detection unit is arranged in the first area.

3. The image forming apparatus according to claim 2, wherein, in a case where a result of detection by one of the second temperature detection unit and the third temperature detection unit exceeds a predetermined temperature, the control unit increases a conveyance interval of recording materials.

4. The image forming apparatus according to claim 1, wherein the fixing unit includes a heater having a substrate on which a plurality of heating elements different in length in the width direction of the recording material is arranged, and wherein, when viewed in a thickness direction of the heater, the first temperature detection unit is arranged at a position overlapping all of the plurality of heating elements.

5. The image forming apparatus according to claim 1, wherein the fixing unit is arranged at a position higher than a position of the attachment part in a height direction of the image forming apparatus in a state where the image forming apparatus is installed.

6. The image forming apparatus according to claim 1, further comprising:

a film having an internal space formed by the film where a heater is arranged; and a pressure roller having a drive gear and forming a nip portion with the heater via the film, wherein the drive gear of the pressure roller is arranged in the second area in the width direction of the recording material.

7. An image forming apparatus comprising:

an image bearing member;

a developer bearing member configured to develop an electrostatic latent image formed on the image bearing member as an image using developer;

a frame configured to support the developer bearing member and including a storage portion for storing the developer, where the stored developer is to be supplied to the developer bearing member and the frame includes an attachment part in which a supply container with developer enclosed in the supply container is attachable to and detachable from the attachment part;

a transfer unit configured to transfer the developed image onto a recording material;

a fixing unit configured to fix the image to the recording material and including a heater having a substrate on which a heating element is arranged;

a first temperature detection unit configured to detect a temperature of the fixing unit;

a cover movable between a first position where the attachment part is covered and disables access from outside and a second position where the attachment part is exposed and enables access from outside; and a control unit configured to control supply of electric power to the fixing unit based on a result of detection by the first temperature detection unit, wherein the recording material with the image formed on the recording material is stacked on the cover in a state where the cover is in the first position, wherein the supply container is configured such that, when the supply container is attached to the attachment part when the cover is located at the second position, the developer enclosed in the supply container is movable to the storage portion under a weight of the enclosed developer, wherein the cover is movable from the second position to the first position in a state where the supply container is detached from the attachment part, and wherein, with reference to a center of the heater in a longitudinal direction of the heater and in a case where an area on one side of the heater center is designated as a first area and the area on the other side of the heater center is designated as a second area, the attachment part is arranged in the first area and the first temperature detection unit is arranged in the second area.

8. The image forming apparatus according to claim 7, further comprising:

a second temperature detection unit configured to detect a temperature of the fixing unit; and a third temperature detection unit configured to detect a temperature of the fixing unit, wherein the second temperature detection unit is arranged in the second area, and the third temperature detection unit is arranged in the first area.

9. The image forming apparatus according to claim 8, wherein, in a case where a result of detection by one of the second temperature detection unit and the third temperature detection unit exceeds a predetermined temperature, the control unit increases a conveyance interval of recording materials.

10. The image forming apparatus according to claim 7, wherein the fixing unit includes a plurality of heating elements different in length in the longitudinal direction of the heater, and wherein, when viewed in a thickness direction of the heater, the first temperature detection unit is arranged at a position overlapping all of the plurality of heating elements.

11. The image forming apparatus according to claim 7, wherein the fixing unit is arranged at a position higher than a position of the attachment part in a height direction of the image forming apparatus in a state where the image forming apparatus is installed.

12. The image forming apparatus according to claim 7, further comprising:

a film having an internal space formed by the film where the heater is arranged; and a pressure roller having a drive gear and forming a nip portion with the heater via the film, wherein the drive gear of the pressure roller is arranged in the second area in the longitudinal direction of the heater.

13. An image forming apparatus comprising:

an image bearing member;

a developer bearing member configured to develop an electrostatic latent image formed on the image bearing member as an image using developer;

a frame configured to support the developer bearing member and including a storage portion for storing the developer, where the stored developer is to be supplied to the developer bearing member and the frame includes an attachment part in which a supply container with developer enclosed in the supply container is attachable to and detachable from the attachment part;

a transfer unit configured to transfer the developed image onto a recording material;

a fixing unit configured to fix the image to the recording material and including a heater having a substrate on which a heating element is arranged;

a first temperature detection unit configured to detect a temperature of the fixing unit;

a cover movable between a first position where the attachment part is covered and disables access from outside and a second position where the attachment part is exposed and enables access from outside; and a control unit configured to control supply of electric power to the fixing unit based on a result of detection by the first temperature detection unit, wherein the recording material with the image formed on the recording material is stacked on the cover in a state where the cover is in the first position, wherein the supply container is configured such that, when the supply container is attached to the attachment part when the cover is located at the second position, the developer enclosed in the supply container is movable to the storage portion under a weight of the enclosed developer, wherein the cover is movable from the second position to the first position in a state where the supply container is detached from the attachment part, and wherein, with reference to a center of the heating element in a longitudinal direction of the heating element and in a case where an area on one side of the heating element center is designated as a first area and the area on the other side of the heating element center is designated as a second area, the attachment part is arranged in the first area and the first temperature detection unit is arranged in the second area.

14. The image forming apparatus according to claim 13, further comprising:

a second temperature detection unit configured to detect a temperature of the fixing unit; and a third temperature detection unit configured to detect a temperature of the fixing unit, wherein the second temperature detection unit is arranged in the second area, and the third temperature detection unit is arranged in the first area.

15. The image forming apparatus according to claim 14, wherein, in a case where a result of detection by one of the second temperature detection unit and the third temperature detection unit exceeds a predetermined temperature, the control unit increases a conveyance interval of recording materials.

16. The image forming apparatus according to claim 13, wherein the fixing unit includes a plurality of heating elements different in length in the longitudinal direction of the heating element, and wherein, when viewed in a thickness direction of the heating element, the first temperature detection unit is arranged at a position overlapping all of the plurality of heating elements.

17. The image forming apparatus according to claim 13, wherein the fixing unit is arranged at a position higher than a position of the attachment part in a height direction of the image forming apparatus in a state where the image forming apparatus is installed.

18. The image forming apparatus according to claim 13, further comprising:

a film having an internal space formed by the film where the heater is arranged; and a pressure roller having a drive gear and forming a nip portion with the heater via the film, wherein the drive gear of the pressure roller is arranged in the second area in the longitudinal direction of the heating element.

19. An image forming apparatus comprising:

an image bearing member;

a developer bearing member configured to develop an electrostatic latent image formed on the image bearing member as an image using developer;

a frame configured to support the developer bearing member and including a storage portion for storing the developer, where the stored developer is to be supplied to the developer bearing member and the frame includes an attachment part in which a supply container with developer enclosed in the supply container is attachable to and detachable from the attachment part;

a transfer unit configured to transfer the developed image onto a recording material;

a fixing unit configured to fix the image to the recording material and including a heater having a substrate on which a heating element is arranged;

a first temperature detection unit configured to detect a temperature of the fixing unit;

a cover movable between a first position where the attachment part is covered and disables access from outside and a second position where the attachment part is exposed and enables access from outside; and a control unit configured to control supply of electric power to the fixing unit based on a result of detection by the first temperature detection unit, wherein the recording material with the image formed on the recording material is stacked on the cover in a state where the cover is in the first position, wherein the supply container is configured such that, when the supply container is attached to the attachment part when the cover is located at the second position, the developer enclosed in the supply container is movable to the storage portion under a weight of the enclosed developer, wherein the cover is movable from the second position to the first position in a state where the supply container is detached from the attachment part, and wherein, in a longitudinal direction of the heater and in a case where one of outer walls of the image forming apparatus is designated as a first outer wall and the other outer wall of the image forming apparatus is designated as a second outer wall, the attachment part is arranged at a position closer to the second outer wall than the first outer wall, and the first temperature detection unit is arranged at a position farther away from the second outer wall than the first outer wall.

20. The image forming apparatus according to claim 19, further comprising:

a second temperature detection unit configured to detect a temperature of the fixing unit; and a third temperature detection unit configured to detect a temperature of the fixing unit, wherein the second temperature detection unit is arranged at a position farther away from the second outer wall than the first outer wall, and the third temperature detection unit is arranged at a position closer to the second outer wall than the first outer wall.

21. The image forming apparatus according to claim 20, wherein, in a case where a result of detection by one of the second temperature detection unit and the third temperature detection unit exceeds a predetermined temperature, the control unit increases a conveyance interval of recording materials.

22. The image forming apparatus according to claim 19, wherein the fixing unit includes a plurality of heating elements different in length in the longitudinal direction of the heater, and wherein, when viewed in a thickness direction of the heating element, the first temperature detection unit is arranged at a position overlapping all of the plurality of heating elements.

23. The image forming apparatus according to claim 19, wherein the fixing unit is arranged at a position higher than a position of the attachment part in a height direction of the image forming apparatus in a state where the image forming apparatus is installed.

24. The image forming apparatus according to claim 19, further comprising:

a film having an internal space formed by the film where the heater is arranged; and a pressure roller having a drive gear and forming a nip portion with the heater via the film, wherein the drive gear of the pressure roller is arranged in the second area in the longitudinal direction of the heater.

* * * * *